United States Patent [19]

Guillaume

[11] Patent Number: 4,537,817

[45] Date of Patent: Aug. 27, 1985

[54] WATERPROOF FABRIC AND FABRICATION METHOD THEREOF

[75] Inventor: Jean-Luc Guillaume, Ste Foy les Lyon, France

[73] Assignee: Société a Responsabilité Limitée styled: Speri-France, Melisey, France

[21] Appl. No.: 558,489

[22] Filed: Dec. 6, 1983

[30] Foreign Application Priority Data

Dec. 8, 1982 [FR] France ..... 82 20594

[51] Int. Cl.[3] ..... B32B 7/00

[52] U.S. Cl. ..... 428/260; 427/176; 428/267; 428/269; 428/284; 428/287; 428/290; 428/315.5; 428/316.6; 428/315.9; 428/913

[58] Field of Search ..... 427/176, 244, 246; 428/315.5, 315.9, 260, 265, 267, 290, 913, 269, 287, 284, 316.6

[56] References Cited

U.S. PATENT DOCUMENTS 4,438,167 3/1984 Schwarz ..... 428/290

*Primary Examiner*—James J. Bell

*Attorney, Agent, or Firm*—Thomas W. Speckman

[57] ABSTRACT

The synthetic coating for the textile substrate consists of a thin film of coagulated polyamide with an open, asymmetrical microporous structure, comprising a first layer in direct contact with said substrate, having large, elongated pores extending transversely to the surface of said film and issuing upon the textile substrate, and a second layer with small, open ovoid pores communicating with both the elongated pores and the surface of the coagulated film.

18 Claims, 3 Drawing Figures

WATERPROOF FABRIC AND FABRICATION METHOD THEREOF

BACKGROUND OF THE INVENTION

This invention relates to a waterproof fabric of the type comprising a permeable textile substrate and a water-repellent, synthetic coating firmly adhering to at least one side of said substrate.

This type of fabric has the disadvantage of not "breathing", such that the garments made therewith are repellent in both directions and prevent ventilation of the mass enveloped in said garment.

It is the object of the present invention to eliminate these disadvantages and to provide a fabric which is impermeable to water, yet permeable to air and to gases in general.

To this effect, the synthetic coating used is a thin film of coagulated polyamide having an open, asymmetrical microporous structure and comprising a first layer in direct contact with the textile substrate with large, elongated pores extending transversely to the surface of the film and issuing upon the textile substrate, and a second layer with small, open ovoid pores communicating with both the elongated pores and the surface of the coagulated polyamide film.

The film best suited to this purpose is polyamide 6 or 6/6 film. Such a structure yields a fabric which is impervious to water at atmospheric pressure and at slightly higher pressures, yet remains permeable to gases. This coating has also proved to be outstandingly resistant to abrasion and breaking.

The invention also relates to a method of fabricating a waterproof fabric, wherein a textile substrate having interstices less than 1 mm wide is taut and coated on one side with a thin film of synthetic material and the whole then treated to solidify said film.

Up to now, this type of method has not made it possible to obtain a fabric both impervious to water and permeable to gases.

It is thus another object of the invention to obviate the latter disadvantage.

SUMMARY OF THE INVENTION

This is accomplished in the improved fabrication method according to the invention by spreading on said textile substrate a liquid film at least 50 microns deep, said liquid film of an acid solution containing between 20% and 30% of a polyamide such as polyamide 6 or 6/6 by weight, by immediately neutralizing the action of the acid solution on the textile substrate and coagulating the polyamide of said solution by running the coated fabric product through a base bath, then washing the fabric with water, dewatering it and creasing it to break the continuity of the film skin and open the surface pores.

The method just-described of producing a fabric which is impervious to water but permeable to gases can be easily applied on an industrial scale.

BRIEF DESCRIPTION OF THE DRAWING

The features of the invention will be more readily understood in light of the following description of one embodiment of the fabrication method and of the fabric according to the invention, with reference to the accompanying drawings in which.

DESCRIPTION OF PREFERRED EMBODIMENTS

Figure 2:
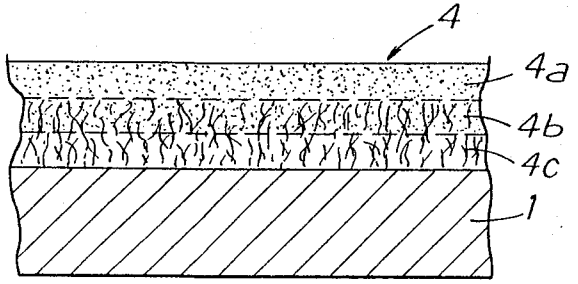
FIG. 2 is a cross-sectional view of the fabric according to the invention.
Figure 1:
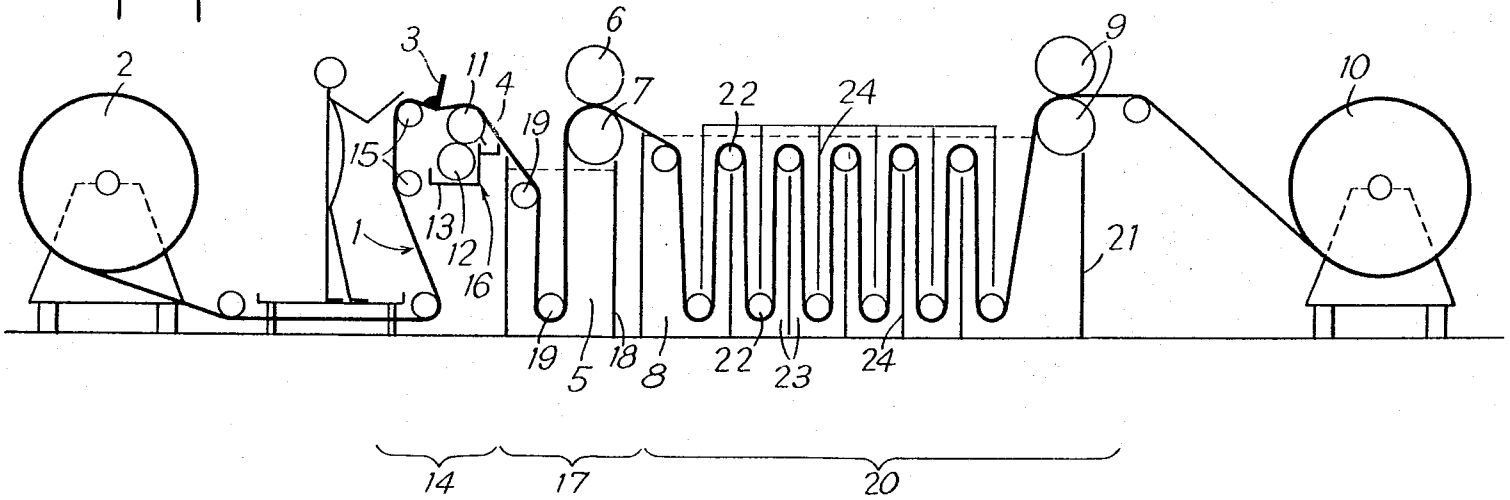
FIG. 1 is a diagram of an apparatus for the fabrication of the gas-permeable waterproof fabric.

The fabrication process according to the invention involves the following steps:

A woven or non-woven fabric having interstices or intervals between different threads, for example between the warp threads and the weft threads, not exceeding 1 mm and preferably not exceeding 0.1 mm, is selected to serve as textile substrate 1. Obviously, the elasticity of said substrate must be at most equal to that of the dry coating film. The liquid film is prepared, in a suitable vessel, in the form of an acid solution containing hydrochloric acid at a concentration of between 5N and 7.5N and polyamide 6 to 6/6 in a proportion of 20% to 30% of the weight of the acid. The polyamide, introduced into the acid in yarn, film or granulated form, is allowed to macerate until fully dissolved. This solution is left to macerate for at least 12 hours to obtain a satisfactory debubbling and may in fact macerate for up to three or four days without significantly altering the mechanical properties of the film subsequently produced with said solution. Experience has shown that polyamide proportions of less than 20% yield too liquid acid solutions which are difficult, if not impossible, to implement as a film on a textile substrate. Similarly, solutions with a proportion of polyamide only slightly greater than 30% are difficult to spread and practically cannot be debubbled.

In addition, a base, such as caustic soda, is also prepared in another suitable vessel. As will occur to those skilled in the art, a number of other bases, such as caustic potash for example, can serve the same purpose. The concentration of caustic soda may vary in the range of 5N to 10N. Said base, for example caustic soda, is used to coagulate the acid solution. A good coagulation is obtained with base concentrations—and in particular with a caustic soda concentration—greater than 5N.

Having prepared the acid solution and the caustic soda or other suitable base, the textile substrate 1 is fed continuously, and preferably at a constant rate—for example at 5 m/min—from a supply roll 2, whereupon the acid solution is applied with a scraper blade 3 to the top surface of the textile substrate 1, as a film 4 the depth whereof is on the order of 60 microns. After a few seconds' wait, say 5 to 10 seconds from the moment of deposition of the film 4, the textile substrate 1, together with its film of acid solution 4, are introduced into a base bath 5, such as caustic soda. Said caustic soda bath 5 serves both to neutralize the action of the acid solution on the textile substrate 1, said substrate being liable in certain cases to be destroyed or damaged if said action were allowed to continue too long, and to coagulate the polyamide contained in the film of said solution 4. It should be noted that the 5N concentration of caustic soda in the bath 5 is in fact a lower limit, still yielding good results, and that as soon as the concentration falls below this value, the film 4 warps and gives rise to surface concretions. Consequently, coagulation is too slow and the polyamide paste of film 4 becomes prone to "stirring" from the eddies occurring as the textile substrate 1/film 4 product is introduced into the caustic soda bath 5. Accordingly, to avoid having to constantly renew the bath 5, it is best to choose a higher concentration of soda, preferably on the order of 10N. It has been observed that a concentration of caustic soda of 10N yields impeccable films of coagulated polyamide 20 microns deep when dried. The textile substrate 1/acid solution film 4 product must soak in the caustic soda bath 5 for a relatively short time, specifically about 8 to 16 seconds, and preferably 12 seconds.

Figure 3:
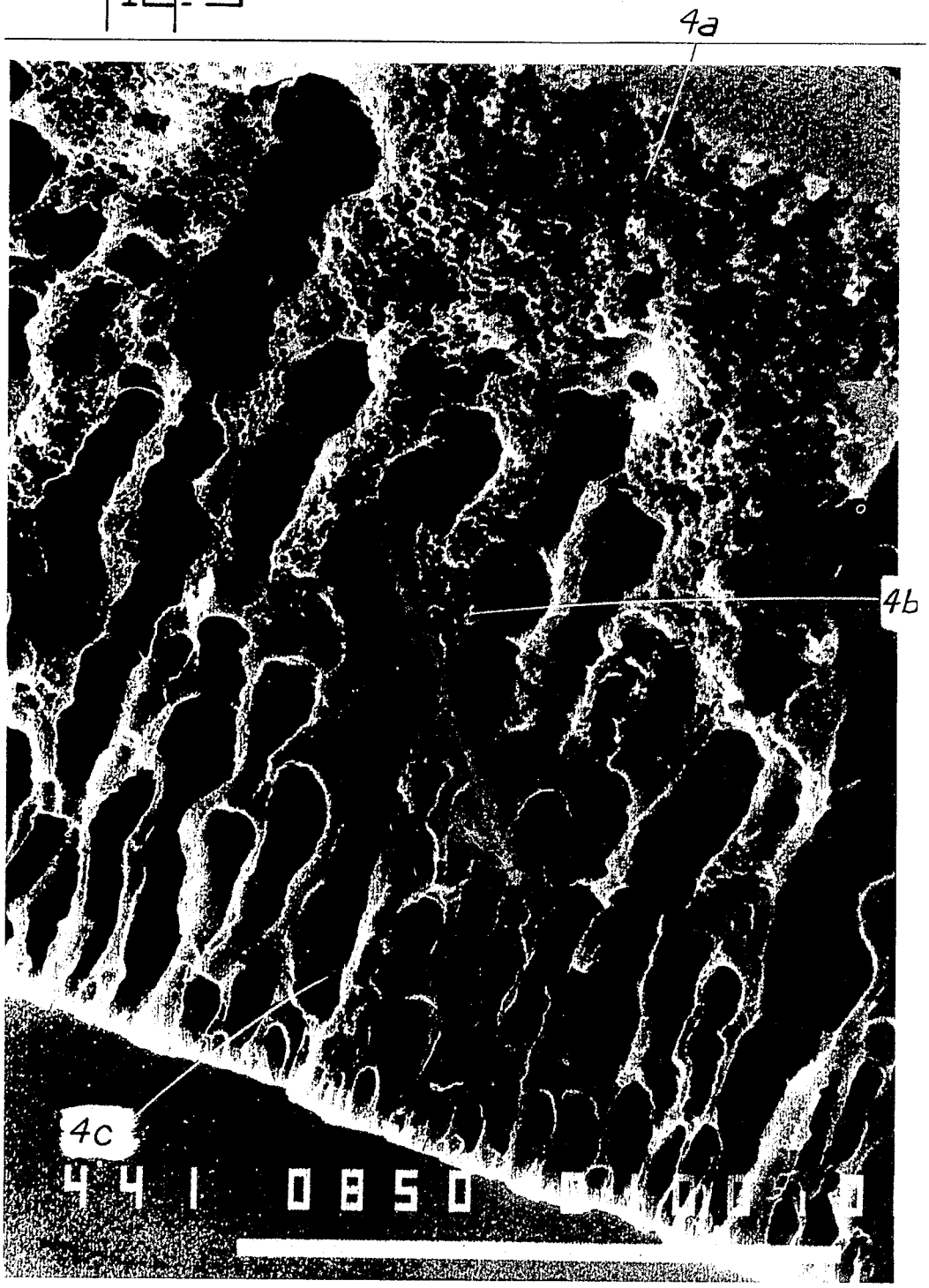
FIG. 3 is a microphotograph showing a cross-section of the coating film on the textile substrate.

Thanks to the just-described coagulation treatment, a film 4 of coagulated polyamide is obtained, having an asymmetrical microporous structure and adhering firmly to the textile substrate 1. As shown in FIGS. 2 and 3, said film 4 comprises an outside layer 4*a* about a third as deep as the film 4 as a whole, said outside layer 4*a* comprising, almost exclusively, small ovoid pores having an average diameter of approximately 0.025 microns and a density on the order of 5 to 15 per square micron. Said film 4 further comprises an intermediate layer 4*b*, also about a third as deep as film 4 as a whole, containing mainly large elongated pores having an average diameter on the order of 1 micron and a density of occurence on the order of 0.4 pores per square micron of cross section. Said large pores are distributed fairly evenly and the walls between the large elongated pores located in the median zone or intermediate layer 4*b* of film 4 are also riddled with small ovoid pores like those of outside layer 4*a* of film 4 (see FIG. 3). Finally, the inside layer 4*c* of film 4, which adheres firmly to the fabric substrate 1 and which is also about a third as deep as film 4 as a whole, contains large elongated pores, extending into intermediate layer 4*b*. The walls between the elongated pores of inside layer 4*c* however lack the small ovoid pores occurring in the walls separating adjacent elongated pores in intermediate layer 4*b*.

It appears, but it is not actually established, that outside layer 4*a* results from an instantaneous coagulation of the polyamide mass caused by a caustic soda having a consistent concentration, whereas the underlying layers 4*b* and 4*c* are coagulated by a caustic soda having been gradually weakened in concentration in reacting with outside layer 4*a* and intermediate layer 4*b*. It appears that, once formed, outside layer 4*a* prevents fresh caustic soda from reaching the underlying layers such that the coagulation reaction is slower and less drastic in said underlying layers 4*b* and 4*c* and produces large pores therein. Obviously, if the textile substrate 1 has openings sufficiently large to allow the caustic soda to also reach localized zones of the inside surface of film 4, the latter could present the same type of pore structure, beginning at said inside surface of film 4 as that occurring at the top or outside surface of film 4. In general, an elongated pore develops more or less transversely with respect to the faces of film 4 and extends lengthwise through more than half of the depth or thickness of said film 4. The mouths or openings of the large pores on the inside face of film 4 often communicate with several elongated pores.

After passing briefly through the coagulation bath 5, the textile substrate 1/film 4 product or waterproof fabric is wrung out by pressing between a pair of calendering cylinders 6, 7 and sent to a washing bath 8 generally containing water, wherein the product is cleaned of any remaining base and of any salts having formed and deposited thereon. The waterproof fabric 1, 4 is then wrung out again between a second pair of calendering cylinders 9 before being wound on a take-up roll 10, or subjected to a breaking operation following drying of said fabric 1, 4, or to a hydrophobization process or other treatment prior to winding on said take-up roll 10.

It has been observed that many of the mouths of the large and small pores at the surface of microporous film 4 are closed off by a thin skin which can be destroyed during the breaking operation, said operation consisting in running the fabric 1, 4 over several small-diameter bars and wringing it if need be between two successive bars. To make the fabric 1, 4 impervious to water, one solution consists in running said fabric 1, 4 through a weak silicone bath (silicone concentration of 0.5% by weight). This yields a water-repellent fabric the film 4 whereof comprises open, ie. unsealed pores.

It is known that a textile substrate 1 of polyamide or of natural cloth can be attacked by the acid polyamide solution used to produce the waterproof fabric. To preclude an excessive attack of the textile substrate 1 between the time of its coating with the acid solution and the latter's neutralization in the bath 5, the bottom of the textile substrate 1 may be lightly coated with a base, such as caustic soda, on completion of, or immediately following the coating or sizing of the top surface of the textile substrate. To this end, a sizing roller 11 can be provided, located beneath the downstream end of the sagging portion of the textile substrate 1, within the acid coating zone, said sizing roller 11 resting on a wetting roller 12 dipping partially into a base bath 13 such as a caustic soda bath. Clearly, the amount of base thus deposited on the bottom surface of the textile substrate 1 and serving as a protective film, is not sufficient to cause coagulation of the film of acid/polyamide solution 4.

Alternatively, said textile substrate can be protected by coating its top surface with porous acrylic some tens of microns deep to isolate said substrate 1 from the film of acid/polyamide solution 4. In other words, the acrylic layer acts as an intermediate isolating film with respect to the acid solution but is sufficiently porous to not hinder the effects of the porosity of coagulated polyamide film 4.

An attack of the textile substrate 1 by the acid/polyamide solution 4 can further be avoided by shortening the time between application to the film of acid solution and passage of the coated fabric 1 through the base bath 5 to less than three seconds, ie. by proceeding with coagulation of the film of acid solution 4 immediately following sizing of the textile substrate.

The installation for implementing the fabrication process comprises, successively from upstream to downstream, in the direction of running of the textile substrate 1: a supply roll 2, an acid coating or sizing station 14 comprising the scraper blade 3 and an acid/polyamide solution feeding device not shown, several intermediate rollers 15 for the textile substrate 1 and, optionally, a backcoating device 16, comprising base bath 13, sizing roller 11 and wetting roller 12; a coagulation station 17 including base bath 5 and its container vessel 18, also provided with two intermediate rollers 19 for textile substrate 1 and with a pair of calenders 6, 7 which return the excess caustic soda to vessel 18, a washing station 20 the vat 21 whereof contains the washing bath 8, such as a water bath, and a certain number of intermediate rollers 22 placed alternately at the top and the bottom of the bath 8, said bath 8 being separated into compartments 23 by baffle plates 24, as well as the pair of calendering cylinders 9 used to wring out the waterproof fabric 1, 4; and finally a take-up roll 10.

It should be noted that the softening and/or hydrophobization operations can be carried out on the waterproof fabric 1, 4 after its loading onto the take-up roll 10. Obviously, the fabric 1, 4 will have to be unrolled for these treatments. The softening process considerably increases the permeability to air of said fabric 1, 4. It has been established that the finish softening process can increase air permeability by 50%. The measured permeability of a fabric according to the invention corresponds to an air flow of 0.1 $cm^3/cm^2/sec$ on application of a 7 cm $H_2O$ vacuum. Clearly then, the fabric according to the invention is particularly well suited to the manufacture of garments required to be impermeable to water whilst allowing a certain amount of "breathing", without it being necessary to provide openings or other special passages therefor in said garments.

It will be understood that a certain number of modifications may be made to the above-described examples of the invention without departing from the spirit and scope of the invention as defined by the claims attached herewith.

What is claimed is:

1. A waterproof fabric fabricated by the textile substrate having interstices less than 1 mm wide being taut and coated on one side with a thin film of liquid synthetic material and the whole is treated to solidify said film, wherein said film consists of an acid solution containing between 20 percent and 30 percent of a polyamide by weight, and is applied to said textile substrate to a depth of at least 50 microns by spreading in liquid form, whereafter the action of the acid solution on said textile substrate is immediately neutralized and the polyamide of said solution is coagulated by running the coated fabric product through a base bath, and the fabric is thereupon washed in water and dewatered, wherein said coagulated film adjacent to said textile substrate has elongated pores extending transversely to said film, said pores open to said textile substrate, and said coagulated film adjacent its surface away from said fabric substrate has smaller, open ovoid pores communicating with both said surface and said elongated pores.

2. A fabric as in claim 1, wherein said film further comprises an intermediate layer having elongated pores, the walls separating said elongated pores in said intermediate layer containing small ovoid pores.

3. A fabric as in claim 11, wherein the small ovoid pores have an average diameter on the order of 0.025 microns and have a density of occurence of 5 to 15 pores/$micron^2$.

4. A fabric as in claim 1, wherein the large elongated pores have an average diameter on the order of 1 micron and a density of occurence on the order of 0.4 pores/$micron^2$ of cross section.

5. A fabric as in claim 1, wherein said coagulated polyamide film is on the order of 20 microns thick.

6. A fabric as in claim 1, wherein said polyamide is selected from the group consisting of polyamide 6 and polyamide 6/6.

7. A fabrication method for a waterproof fabric, whereby a textile substrate having interstices less than 1 mm wide is taut and coated on one side with a thin film of liquid synthetic material and the whole is treated to solidify said film, wherein said film consists of an acid solution containing between 20% and 30% of a polyamide by weight, and is applied to said textile substrate to a depth of at least 50 microns by spreading in liquid form, whereafter the action of the acid solution on said textile substrate is immediately neutralized and the polyamide of said solution is coagulated by running the coated fabric product through a base bath, and the fabric is thereupon washed in water and dewatered.

8. A fabrication method as in claim 7, whereby the coated fabric is dried, then subjected to a softening process.

9. A fabrication method as in claim 7 whereby the coated fabric is subjected to hydrophobization.

10. A fabrication method as in claim 7, whereby the textile substrate is protected from attack by the acid polyamide solution before being introduced into the base bath.

11. A fabrication method as in claim 7, wherefor the base bath concentration is kept in the 5N to 10N range.

12. A fabrication method as in claim 7, wherein said polyamide is selected from the group consisting of polyamide 6 and polyamide 6/6.

13. A fabrication method as in claim 7 whereby said coated fabric product is kept in said base bath for about 8 to about 16 seconds.

14. A fabrication method as in claim 13 whereby said coated fabric product is kept in said base bath for about 12 seconds.

15. A fabrication method as in claim 7 whereby said base bath comprises caustic soda.

16. A fabrication method as in claim 7 whereby said acid solution is applied with a scraper blade to the top surface of said textile substrate.

17. A fabrication method as in claim 7 whereby said acid solution comprises hydrochloric acid at a concentration of between 5N and 7.5N.

18. A fabrication method as in claim 7 whereby the bottom surface of said textile substrate is lightly coated with a base immediately following said application of said acid solution to said textile substrate.

* * * * *